United States Patent [19]

Hurko

[11] 3,931,496

[45] Jan. 6, 1976

[54] ELECTRICAL HEATING PLATE WITH TERMINAL MEANS FOR HIGH TEMPERATURE FILM HEATER

[75] Inventor: Bohdan Hurko, Louisville, Ky.

[73] Assignee: General Electric Company, Louisville, Ky.

[22] Filed: Nov. 21, 1974

[21] Appl. No.: 525,846

[52] U.S. Cl. ..... 219/543; 219/464; 117/212; 338/309

[51] Int. Cl.² ..... H05B 3/16

[58] Field of Search ..... 219/203, 464, 522, 543; 338/308, 309; 117/105.2, 212, 217

[56] References Cited

UNITED STATES PATENTS

| | | | |
|---|---|---|---|
| 2,628,299 | 2/1953 | Gaiser | 338/309 X |
| 2,748,234 | 5/1956 | Clarke et al. | 338/309 X |
| 2,882,377 | 4/1959 | Rinehart | 219/543 X |
| 3,067,310 | 12/1962 | Walz et al. | 219/543 X |
| 3,067,315 | 12/1962 | Hurko | 219/543 |
| 3,266,661 | 8/1966 | Dates | 219/543 X |
| 3,296,574 | 1/1967 | Tassara | 338/309 |
| 3,336,465 | 8/1967 | Hurko | 219/543 X |
| 3,757,087 | 9/1973 | Bernard | 219/543 X |
| 3,811,934 | 5/1974 | Glaser | 117/212 |
| 3,813,520 | 5/1974 | Brouneus | 219/543 |

*Primary Examiner*—Volodymyr Y. Mayewsky

[57] ABSTRACT

A dielectric substrate is provided with a thin narrow heater strip of multi-layer metallic films of noble metals such as platinum and gold. The film heater is bonded to the substrate and it has terminal means comprising a silver film electrode that is spaced away from the film heater. A metal oxide diffusion barrier such as a tin oxide film bridges the gap between the film heater and the silver electrode and retards the electromigration and mass flow between the film heater and the electrode.

8 Claims, 4 Drawing Figures

ELECTRICAL HEATING PLATE WITH TERMINAL MEANS FOR HIGH TEMPERATURE FILM HEATER

CROSS-REFERENCE TO RELATED APPLICATION

A related design of solid plate surface unit or glass-ceramic cooktop with an electrical film heater pattern to obtain an even temperature distribution across the top surface of the heated area is described in a copending patent application of the present inventor, Ser. No. 468,753, entitled "Glass-Ceramic Cooktop With Film Heaters", now U.S. Pat. No. 3,883,719 dated May 13, 1975. This earlier film heater design had terminals of relatively low resistance per unit area by using a layer of silver so that the terminals remain relatively cool as compared with the main heated portion of the film heater pattern.

BACKGROUND OF THE INVENTION

1. Field of the Invention

The invention relates to an electric heating means and particularly to a multi-layer, electrical film heater in strip form having an improved terminal means.

2. Description of the Prior Art

A solid plate surface heating unit design with a multi-layer, thin film heater in strip form bonded to the underside of a high silica glass plate is described in an earlier patent of the present inventor, U.S. Pat. No. 3,067,315, which is also assigned to the same assignee as is the present invention. This patent shows the film heater terminals located on a down-turned tongue portion near the peripheral edge of the plate beneath a reflector pan so as to be remote and shielded from the main heated portion of the film heater and to create a large temperature drop of several hundred degrees Fahrenheit between the heated portion and the terminals.

Another solid plate surface heating unit design with an electrical film heater is shown in the Brouneus U.S. Pat. No. 3,813,520. This film heater design includes a pair of metallic thin film terminals of a low electrical resistance material.

The principal object of the present invention is to provide an electrical thin film heater of noble metals with diffusion barrier means interposed between the main portion of the film heater and its electrodes.

A further object of the present invention is to provide a solid plate surface heating unit with a high temperature film heater of noble metals and barrier means to prevent electromigration between dissimilar noble metals at the separation plane of the electrode.

SUMMARY OF THE INVENTION

The present invention, in accordance with one form thereof, relates to a high temperature metallic film heater bonded to the underside of a dielectric substrate. The film heater is formed of noble metals, while the heater has electrodes of dissimilar noble metal. A diffusion barrier means separates the film heater from the electrodes to prevent electromigration between the film heater and the electrodes.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
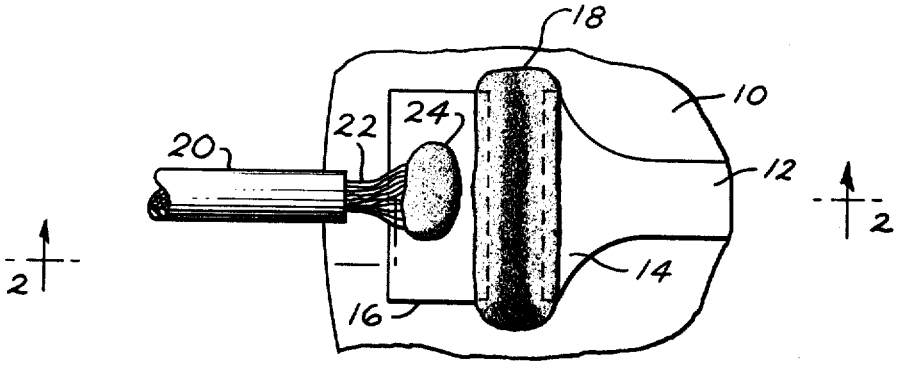
FIG. 1 is a fragmentary bottom plan view of terminal means of a high temperature metallic film heater according to the present invention showing a widened end portion of the film heater, a spaced electrode and a barrier means bridging the film heater and its electrode. A stranded lead wire is joined to the electrode.
Figure 2:
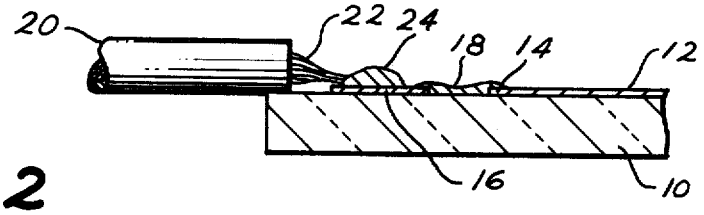
FIG. 2 is a cross-sectional elevational view through the terminal means of FIG. 1, taken on the line 2—2 showing the diffusion barrier lying on top of both the end portion of the film heater and the spaced electrode.

Turning now to a consideration of the drawings, and in particular to the fragmentary view of FIG. 1, there is shown a dielectric substrate 10 such as a thin plate of glassceramic material that has a high dielectric strength, good thermal shock resistance, chemical inertness, good abrasion resistance and mechanical strength. Other substrates could be used satisfactorily; for example, a metal plate carrying a layer of dielectric material on which the film heater would be bonded.

Remember that this plate 10 has been inverted. Bonded to the underside of this plate 10 is a thin metallic film heater 12, although only a short length of the heater is shown. This is because the present invention is in the termination means of this film heater, rather than in the film heater itself. It will be understood by those skilled in this art that this electrical film heater for use as a surface heating means would be of continuous strip form which is typically arranged in a serpentine or a spiral coil having terminals or electrodes at each end. Examples of prior art surface heating unit designs were identified earlier as the Hurko U.S. Pat. No. 3,067,315 and the Brouneus U.S. Pat. No. 3,813,520.

Of course, this invention could be used in other film heater applications such as printed circuits and the like, but the maximum benefits are derived when this invention is used in high temperature applications that reach maximum temperatues somewhere between 900°F and 1500°F.

This film heater 12 is preferably formed of multilayers of noble metals such as is taught in the beforementioned Hurko U.S. Pat. No. 3,067,315. Bonded directly to the dielectric plate 10 is at least an inner layer of platinum and an outer layer of gold to form the film heater layer 12. The platinum inner layer has a relatively high electrical resistance between about 13 and 39 ohms per square. The gold outer layer has a relatively low electrical resistance between about 0.5 and 1.5 ohms per square. The platinum layer has a much higher melting point than the gold so as to retard the crystallization and migration of the gold. The two platinum and gold film layers represent electrical resistances that are arranged in a parallel circuit so that the total electrical resistance of the film heater strip is approximately equal to the low resistance of the outer gold layer.

The end portion 14 of the film heater 12 is widened to about twice its average width. Spaced from the end portion 14 is a silver electrode 16 of about the same width as the end portion 14. The purpose of the increased width of the film terminal means is to reduce the electrical resistance per unit area of the terminal means and thereby reduce its heating action and operating temperature. In the past the silver electrodes 16 have been deposited directly over the film heater end portions 14. However, when these film heaters 12 are operated at temperatures above about 900°F or 1000°F a high rate of film failures may occur at the separation plane between the film heater of noble metals such as platinum and gold and its electrode of dissimilar noble metals such as silver. This is apparently due to the electromigration or diffusion process that occurs at these high temperatures. This effect, sometimes referred to as the Kirkendall effect, is a phenomenon of electromigration-induced failure of thin films of such noble metals as gold and silver and their alloys. The silver atoms are more mobile than the gold atoms, and this difference in mobility is important to the end result. As the diffusion process continues the silver in the electrode 16 migrates toward the gold-platinum film heater 12 and at a greater rate of mass flow than the gold-platinum layer which migrates toward the silver electrode 16. This mass flow would be the highest at the separation plane between the silver and the gold. Only a small number of the voids in the separation plane region that are created by the silver migration are filled by the alternate gold migration. As a result, the film in the area of the separation plane develops discontinuities which eventually cause electrical arcing and runaway failure conditions.

This electromigration phenomenon can be avoided by the use of the present invention as illustrated in FIG. 1. The silver electrode 16 is spaced away from the end portion 14 of the film heater 12. These two members are then joined by a thin metal oxide film diffusion barrier 18 such as a layer of tin oxide. This tin oxide does not migrate to the voids created by the silver migration such that the film heater termination means has a long life span comparable to the long life of the film heater itself.

A lead wire 20 with stranded conductors 22 is shown soldered to the silver electrode 16 as at 24.

Figure 3:
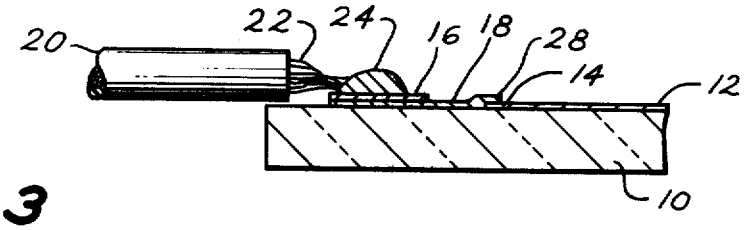
FIG. 3 is a cross-sectional elevational view, similar to that of FIG. 2, of a second modification of the present invention where the diffusion barrier underlies the electrode so as to provide more area for making an electrical connection to the electrode.

In the second modification of FIG. 3, the silver electrode 16 is again spaced from the end portion 14 of the film heater 12. However, the diffusion barrier 18 underlies the silver electrode 16 and overlies the end portion 14 of the film heater 12. This modification has the advantage of providing more useful area of the silver electrode 16 for making the connection with the lead wire 20. The film heater 12 would have to be deposited first onto the substrate 10. Then the tin oxide diffusion barrier 18 would be deposited with a slight overlap at 28. Finally, the silver electrode 16 would be deposited over a portion of the diffusion barrier 18.

Figure 4:
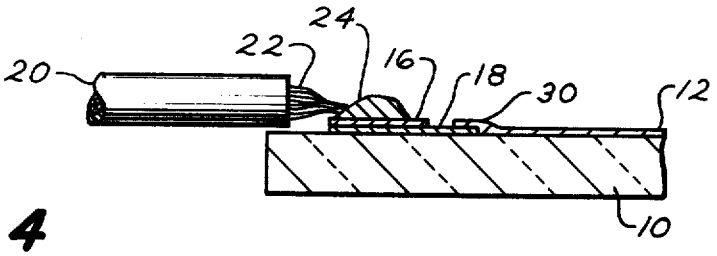
FIG. 4 is also a cross-sectional elevational view, similar to that of FIG. 2, of a third modification of the present invention showing the diffusion barrier underlying the electrode, while the end portion of the film heater overlies an edge of the diffusion barrier, again to be able to take advantage of the entire area of the electrode to make an electrical connection therewith.

The third modification of FIG. 4 is similar to the second modification of FIG. 3 in that the silver electrode 16 is deposited over a portion of the tin oxide layer 18. However, the sequence of firing the different layers is different. The tin oxide layer 18 is first deposited, then the silver electrode 16, and finally the film heater 12 with a slight overlap at 30 over an edge of the tin oxide layer 18.

Modifications of this invention will occur to those skilled in this art. Therefore, it is to be understood that this invention is not limited to the particular embodiment disclosed but that it is intended to cover all such modifications which are within the true spirit and scope of this invention as claimed.

I claim:

1. An electrical heating plate comprising a high temperature electrical resistance heating film bonded to a dielectric substrate, said film comprising a narrow continuous strip of metallic film of noble metals, the film having terminal means in the form of a widened end portion and a widened film electrode of dissimilar noble metal that is adapted to be bonded to the dielectric substrate, the heating film end portion being widely separated from said electrode, and a thin metal oxide film diffusion barrier overlapping both the heating film end portion and the film electrode and bonded to the dielectric substrate so as to bridge the gap between the heating film and the electrode and retard the migration and mass flow between the electrode and the heating film during high temperature operations, said widened film end portion and said widened film electrode reducing the electrical resistance per unit area of the terminal means and thereby reducing its heating action and operating temperature.

2. An electrical heating plate comprising a high temperature electrical resistance heating film bonded to a dielectric substrate as recited in claim 1 wherein the said film terminal means comprising the film end portion and the electrode has about twice the width as the width of the main heated portion of the film.

3. An electrical heating plate comprising a high temperature electrical resistance heating film bonded to a dielectric substrate as recited in claim 2, wherein the said metallic film of noble metals comprises multi-layers with at least one layer of platinum and one layer of gold, and the said film electrode comprises a silver layer.

4. An electrical heating plate comprising a high temperature electrical resistance heating film bonded to a dielectric substrate as recited in claim 3 wherein the said silver film electrode has a width about twice the average width of the multi-layer electrical film, the end of the main heated portion of the heating film also being enlarged to about the width of the electrode, the said diffusion barrier of metal oxide also having a width substantially equal to the width of the electrode so as to reduce the electrical resistance per unit area and hence, the heating action of the electrodes.

5. An electrical heating plate comprising a high temperature electrical heating film bonded to a dielectric substrate as recited in claim 4 wherein the said metal oxide film diffusion barrier is a tin oxide film.

6. An electrical heating plate comprising a high temperature electrical heating film bonded to a dielectric substrate as recited in claim 5 herein and said film diffusion barrier overlies both the film heater and the electrode.

7. An electrical heating plate comprising a high temperature electrical heating film as recited in claim 5 wherein the said film diffusion barrier underlies the electrode and overlies the edge of the film heater.

8. An electrical heating plate comprising a high temperature electrical heating film bonded to a dielectric substrate as recited in claim 5 wherein the said film diffusion barrier underlies the said electrode, and the edge of the film heater overlies the adjacent edge of the film diffusion barrier.

* * * * *